US011540958B2

(12) United States Patent
Moore

(10) Patent No.: US 11,540,958 B2
(45) Date of Patent: Jan. 3, 2023

(54) MODULAR SEAT APPARATUSES FOR WHEELCHAIR ASSEMBLIES

(71) Applicant: Toyota Motor North America, Inc., Plano, TX (US)

(72) Inventor: Douglas A. Moore, Fairview, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 500 days.

(21) Appl. No.: 16/688,299

(22) Filed: Nov. 19, 2019

(65) Prior Publication Data

US 2021/0145668 A1 May 20, 2021

(51) Int. Cl.

| | |
|---|---|
| ***A61G 5/08*** | (2006.01) |
| ***A61G 5/02*** | (2006.01) |
| ***A61G 5/10*** | (2006.01) |

(52) U.S. Cl.

CPC ..... *A61G 5/08* (2013.01); *A61G 5/02* (2013.01); *A61G 5/1048* (2016.11); *A61G 5/1045* (2016.11); *A61G 5/1091* (2016.11)

(58) Field of Classification Search

CPC .. A61G 5/1048; A61G 5/1045; A61G 5/1043; A61G 5/1067; A61G 2203/74; A47C 7/46

See application file for complete search history.

(56) References Cited

U.S. PATENT DOCUMENTS

| | | | | |
|---|---|---|---|---|
| 5,437,496 | A * | 8/1995 | Rickard | A61G 5/10 297/283.2 |
| 6,129,415 | A * | 10/2000 | Galloway | A61G 5/12 297/423.26 |
| 6,595,588 | B2 | 7/2003 | Ellerich et al. | |
| 7,296,856 | B2 * | 11/2007 | Rozaieski | A61G 5/1067 297/358 |
| 7,540,564 | B2 | 6/2009 | Gokhale | |
| 7,712,834 | B2 | 5/2010 | Knoblock et al. | |
| 8,646,795 | B2 * | 2/2014 | Cerreto | B60N 2/22 297/354.12 |
| 2014/0103688 | A1 | 4/2014 | Wilson | |

FOREIGN PATENT DOCUMENTS

| | | | |
|---|---|---|---|
| CA | 1321539 | C | 8/1993 |
| CN | 205513573 | U | 8/2016 |
| DE | 102009025274 | B4 | 5/2017 |
| JP | 2018090162 | A | 6/2018 |

* cited by examiner

*Primary Examiner* — Jacob B Meyer
*Assistant Examiner* — Harold Eric Pahlck, III
(74) *Attorney, Agent, or Firm* — Dinsmore & Shohl LLP

(57) ABSTRACT

A modular seat apparatus includes a base cushion and a back cushion that includes a plurality of segments defining a longitudinal length of the back cushion. The back cushion is pivotably coupled to the base cushion such that the back cushion is oriented at an angle relative to the base cushion. The plurality of segments is configured to translate in response to the back cushion pivoting relative to the base cushion such that the longitudinal length of the back cushion decreases as the angle increases and the longitudinal length of the back cushion increases as the angle decreases.

20 Claims, 9 Drawing Sheets

MODULAR SEAT APPARATUSES FOR WHEELCHAIR ASSEMBLIES

TECHNICAL FIELD

The present specification generally relates to seat apparatuses that provide reclining functionality for transitioning a seatback from an inclined position to reclined position while maintaining comfort of an occupant seated thereon, and more specifically to wheelchair assemblies designed to reduce a shear on a lower back of an occupant when reclining a seatback of the wheelchair assembly.

BACKGROUND

Seat apparatuses generally provide a surface for an occupant to be received for maintaining the occupant in a basic human resting position. Some seat apparatuses, such as wheelchair assemblies, include a reclining functionality that allow a seatback of the wheelchair to move relative to a seat base of the wheelchair. In this instance, an occupant seated on the wheelchair assembly may transition from an inclined position, where the seatback is positioned generally upright relative to the seat base, to a reclined position where the seatback is positioned generally parallel relative to the seat base.

Transitioning a seat apparatus from an inclined position to a reclined position with an occupant seated thereon may generate a shear along a lower back of an occupant due to a relative movement of the seat apparatus between the seat back and the seat base. With a lower back of an occupant positioned adjacently thereto, the shear generated by the seat apparatus and applied to a lower back of the occupant may cause discomfort. Accordingly, there exists a lack of seat apparatuses designed to include reclining functionality that are particularly configured to reduce a shear on a lower back of an occupant.

SUMMARY

In one embodiment, a modular seat apparatus including a base cushion and a back cushion including a plurality of segments defining a longitudinal length of the back cushion. The back cushion is pivotably coupled to the base cushion such that the back cushion is oriented at an angle relative to the base cushion. The plurality of segments is configured to translate in response to the back cushion pivoting relative to the base cushion such that the longitudinal length of the back cushion decreases as the angle increases and the longitudinal length of the back cushion increases as the angle decreases.

In another embodiment, a wheelchair assembly including a base frame including a plurality of wheels coupled thereto, and a back frame including a plurality of cushion segments that define a length of the back frame. The back frame is pivotable relative to the base frame about a gap formed therebetween. The plurality of cushion segments is configured to translate relative to the gap in response to the back frame pivoting relative to the base frame such that the length of the back frame is selectively adjustable as an angle between the back frame and the base frame is increased or decreased. The length of the back frame decreases as the angle between the back frame and the base frame increases, and the length of the back frame increases as the angle between the back frame and the base frame decreases.

In another embodiment, a wheelchair assembly includes a base frame including a base cushion positioned thereon, a back frame including at least one roller, and a translatable cover disposed about the back frame and the at least one roller. Wherein the at least one roller is operable to translate a user-facing surface of the translatable cover toward and away from the base frame based on an angle between the back frame and the base frame.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

The present disclosure relates generally to a modular seat apparatus, such as a wheelchair assembly, that at least partially reduces a shear imparted on a body of an operator seated on the seat apparatus in response to a transition of the seat apparatus between various reclining positions. In particular, pivoting a back frame of a seat apparatus from an inclined position to a reclined position relative to a base frame of the seat apparatus may generate discomfort to an occupant seated on the base frame as a portion of an occupant's body located adjacent to and between a juncture of the back frame and the base frame may experience a shear from said movement. Providing a seat apparatus, and specifically a wheelchair assembly, that prevents and/or at least partially inhibits a shear force transfer against an occupant's body may alleviate discomfort.

Modular seat apparatuses, such as that of a wheelchair assembly, may include a base frame including a plurality of wheels coupled thereto and a base cushion disposed thereon. The modular seat apparatus further includes a back frame including a back cushion disposed thereon. The back cushion comprises a plurality of cushion segments that define a longitudinal length of the back cushion and that are movably coupled to the back frame. The back frame is pivotably coupled to the base frame about a gap that is formed therebetween, such that the back frame and the back cushion disposed thereon is positioned at an angle relative to the base frame and the base cushion disposed thereon, respectively.

The plurality of cushion segments of the back cushion that are configured to slidably translate relative to the gap and along the back frame in response to the back frame pivoting relative to the base frame. The longitudinal length of the back cushion decreases as the angle between the back frame and the base frame increases, and the longitudinal length of the back cushion increases as the angle between the back frame and the base frame decreases. With the longitudinal length of the base cushion being selectively adjusted based on an angle of orientation of the back frame, the shear force applied to a lower back of an occupant seated on the seat apparatus may be proactively minimized to reduce instances of possible discomfort.

Figure 1:
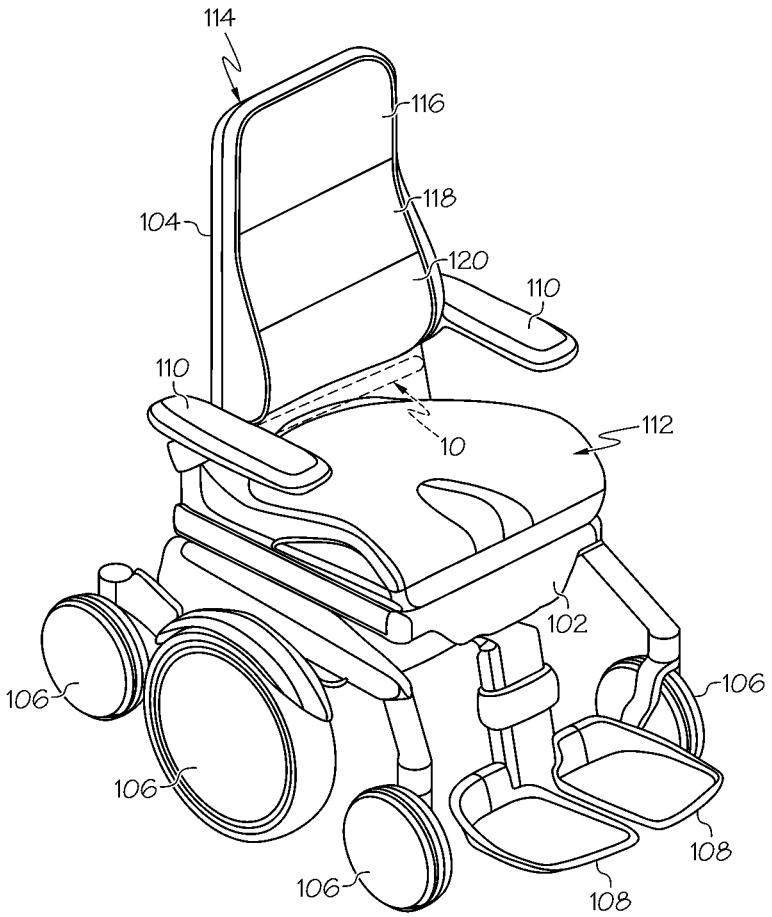
FIG. 1 schematically depicts a perspective view of an illustrative wheelchair assembly including a modular seat apparatus according to one or more embodiments of the present disclosure.

Referring now to the drawings, FIG. 1 depicts an illustrative wheelchair assembly 100 including a base frame 102, a back frame 104, one or more wheels 106, a pair of foot rests 108, and a pair of arm rests 110. The back frame 104 is pivotably coupled to the base frame 102 at a coupling point 10 (i.e. spatial gap) disposed therebetween. The one or more wheels 106 are rotatably coupled to the base frame 102 and configured to facilitate movement of the wheelchair assembly 100. In the embodiment, the wheelchair assembly 100 includes a plurality of wheels 106 coupled to the base frame 102, however, it should be understood that in other embodiments the wheelchair assembly 100 may include additional and/or fewer wheels 106 than those shown and described herein. The base frame 102 of the wheelchair assembly 100 includes a base cushion 112 and the back frame 104 includes a modular back cushion 114 (i.e. a modular seat apparatus).

In particular, the modular back cushion 114 includes a plurality of cushion segments 116, 118, 120 extending along the back frame 104, with the plurality of cushion segments 116, 118, 120 defining a longitudinal length of the modular back cushion 114. The back frame 104 is pivotably coupled to the base frame 102 such that the modular back cushion 114 is positioned at an angle relative to the base cushion 112. As described in greater detail herein, the back frame 104 is configured to move relative to the base frame 102 through a plurality of positions such that the back cushion 114 may be positioned at a plurality of angles relative to the base cushion 112. The plurality of cushion segments 116, 118, 120 of the back cushion 114 are movably coupled to the back frame 104 such that the plurality of cushion segments 116, 118, 120 of the back cushion 114 is configured to translate along the back frame 104.

Figure 2A:
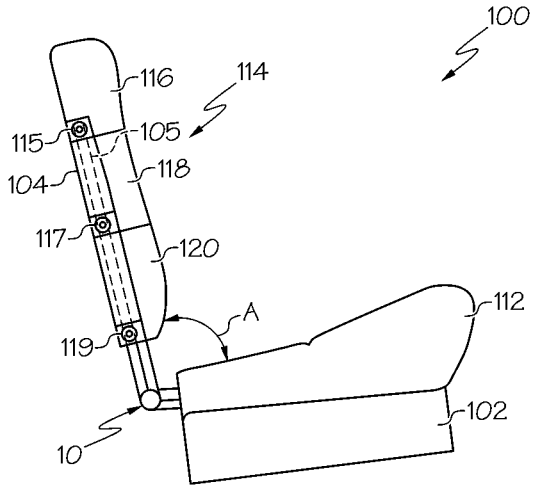
FIG. 2A schematically depicts a side cross-sectional view of the wheelchair assembly of FIG. 1 with the modular seat apparatus in an inclined position according to one or more embodiments of the present disclosure.

Referring now to FIG. 2A, each of the plurality of cushion segments 116, 118, 120 of the back cushion 114 includes a coupling mechanism 115, 117, 119 disposed within the cushion segment 116, 118, 120, respectively. The back frame 104 of the wheelchair assembly 100 includes a channel 105 disposed therein, and more specifically, the channel 105 extends along a longitudinal length of the back frame 104. The channel 105 is sized and shaped to slidably receive each of the plurality of coupling mechanisms 115, 117, 119 of the plurality of cushion segments 116, 118, 120. The coupling mechanism 115, 117, 119 of each of the plurality of cushion segments 116, 118, 120 is movably coupled to the channel 105 such that the plurality of cushion segments 116, 118, 120 of the back cushion 114 is configured to move relative to the back frame 104 in response to the plurality of coupling mechanisms 115, 117, 119 translating within the channel 105. The channel 105 of the back frame 104 may comprise various mechanisms, such as, for example, a rail system configured to hinge the plurality of cushion segments 116, 118, 120 thereto via internal linkage with the respective coupling mechanisms 115, 117, 119. It should be understood that the plurality of coupling mechanisms 115, 117, 119 may be movably coupled to the back frame 104 by other mechanisms.

In the embodiment, the back cushion 114 of the wheelchair assembly 100 includes three cushion segments 116, 118, 120 coupled to the back frame 104 via three respective coupling mechanisms 115, 117, 119. It should be understood that in other embodiments the back cushion 114 of the wheelchair assembly 100 may include additional and/or fewer cushion segments and/or corresponding coupling mechanisms coupled to the channel 105 of the back frame 104 than those shown and described herein without departing from a scope of the present disclosure. It should further be understood that the plurality of coupling mechanism 115, 117, 119 of the plurality of cushion segments 116, 118, 120 may comprise various suitable devices for slidably translating the plurality of cushion segments 116, 118, 120 along the channel 105 of the back frame 104. By way of illustrative example only, the plurality of coupling mechanism 115, 117, 119 of the plurality of cushion segments 116, 118, 120 may comprise rollers, wheels, linkages, hinges, and/or the like.

Still referring to FIG. 2A, the wheelchair assembly 100 is schematically depicted in an inclined position with the back frame 104 positioned at a first angle A relative to the base frame 102. For example, the back frame 104 may be positioned about the coupling point 10 ranging from about a 10° (degree) angle to about a 110° (degree) angle relative to the base frame 102 when the wheelchair assembly 100 is in the inclined position. With the wheelchair assembly 100 in the inclined position, the plurality of cushion segments 116, 118, 120 of the back cushion 114 abut against one another and are moved along the back frame 104 distally from the coupling point 10 and/or the base cushion 112. In other words, the coupling mechanism 115, 117, 119 of each of the plurality of cushion segments 116, 118, 120 is positioned within the channel 105 of the back frame 104 at a first, distal position relative to the coupling point 10 and/or the base cushion 112.

Figure 2B:
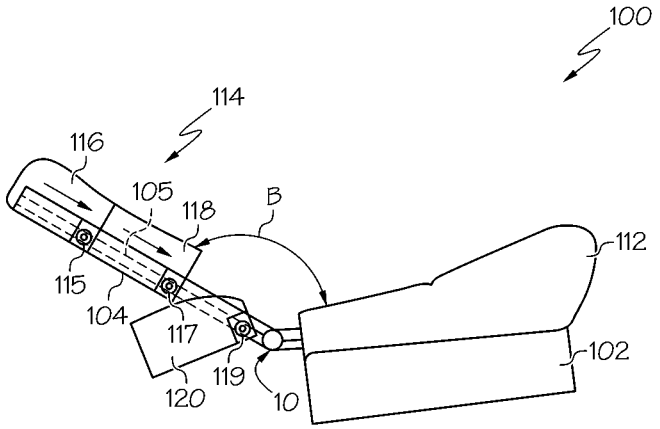
FIG. 2B schematically depicts a side cross-sectional view of the wheelchair assembly of FIG. 1 with the modular seat apparatus in a reclined position according to one or more embodiments of the present disclosure.

Referring now to FIG. 2B, the wheelchair assembly 100 is schematically depicted in a reclined position with the back frame 104 and the back cushion 114 positioned at a second angle B relative to the base frame 102 and the base cushion 112, where the second angle B is greater than the first angle A of the inclined position. It should be understood that the wheelchair assembly 100 may be actuated to move from the inclined position (FIG. 2A) to the reclined position by various mechanical and/or electro-mechanical mechanisms, such as, for example, a manual actuator, an electrical motor, and/or the like. The back frame 104 may be positioned about the coupling point 10 ranging from about a 110° (degree) angle to about a 180° (degree) angle relative to the base frame 102 when the wheelchair assembly 100 is in the reclined position. With the wheelchair assembly 100 in the reclined position, the plurality of cushion segments 116, 118, 120 of the back cushion 114 are moved along the back frame 104 proximally toward the coupling point 10 and/or the base cushion 112. In other words, the coupling mechanism 115, 117, 119 of each of the plurality of cushion segments 116, 118, 120 is positioned within the channel 105 of the back frame 104 at a second, proximal position relative to the coupling point 10 and/or the base cushion 112. It should be understood that the plurality of cushion segments 116, 118, 120 translate along the back frame 104 in response to the back cushion 114 pivoting relative to the base cushion 112 to the reclined position of the wheelchair assembly 100.

In the illustrated embodiment, at least a first cushion segment 120 of the plurality of cushion segments 116, 118, 120 is configured to pivot relative to the back frame 104 and/or the other plurality of cushion segments 116, 118. In particular, the first cushion segment 120 is configured to pivot about the coupling mechanism 119. In this instance, at least a portion of the first cushion segment 120 is positioned relatively behind at least a second cushion segment 118 and/or a third cushion segment 120 of the plurality of cushion segments 116, 118, 120 when the angle at the coupling point 10 between the back frame 104 and the base frame 102 decreases. In this instance, a longitudinal length of the back cushion 114 of the wheelchair assembly 100 decreases as the first cushion segment 120 pivots relative to the remaining plurality of cushion segments 116, 118 as the wheelchair assembly 100 transitions from the inclined position to the reclined position. Accordingly, it should be understood that a longitudinal length of the back cushion 114 is selectively adjustable and decreases as the angle between the back frame 104 and the base frame 102 increases, and a longitudinal length of the back cushion 114 increases as the angle between the back frame 104 and the base frame 102 decreases.

Still referring to FIG. 2B, with at least the first cushion segment 120 of the plurality of cushion segments 116, 118, 120 translated proximally toward the coupling point 10 and pivoted outwardly relative to the base frame 102, the other cushion segments 116, 118 move proximally toward the coupling point 10 as the coupling mechanisms 115, 117 translate along the channel 105 of the back frame 104. In other words, pivoting the first cushion segment 120 outwardly from the back frame 104 and distally from the base frame 102 provides increased spatial clearance along the back frame 104 for other cushion segments 116, 118 of the back cushion 114 to translate downward along the back frame 104. In some embodiment, at least the second cushion segment 118 is configured to translate at least partially over the first cushion segment 120 in response to the first cushion segment 120 pivoting relatively behind the second cushion segment 118. In this instance, the second cushion segment 118 is disposed at least partially over the first cushion segment 120.

With at least the first cushion segment 120 configured to pivot outwardly away from the base cushion 112 as the wheelchair assembly 100 is transitioned to the reclined position, the back cushion 114 of the wheelchair assembly 100 is operable to minimize a shear stress generated on, for example, an occupant received on the wheelchair assembly 100. More specifically, pivoting the first cushion segment 120 distally from the base cushion 112 and simultaneously translating the remaining plurality of cushion segments 116, 118 toward the coupling point 10 reduces a force applied onto a lower back of an occupant seated on the base cushion 112 as the wheelchair assembly 100 is reclined. One or more of the remaining plurality of cushion segments 116, 118, such as the second cushion segment 118, slidably translates at least partially over the first cushion segment 120 when the first cushion segment 120 pivots outwardly to further minimize a shear stress and/or force transmitted to an occupant utilizing the wheelchair assembly 100. By minimizing a shear stress and/or force when the wheelchair assembly 100 transitions from the inclined position (FIG. 2A) to the reclined position (FIG. 2B), instances of discomfort may be minimized.

Figure 3A:
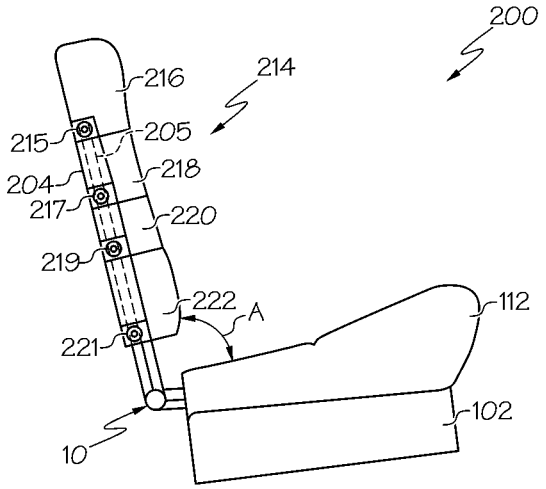
FIG. 3A schematically depicts a side cross-sectional view of an illustrative wheelchair assembly with a modular seat apparatus in an inclined position according to one or more embodiments of the present disclosure.
Figure 3B:
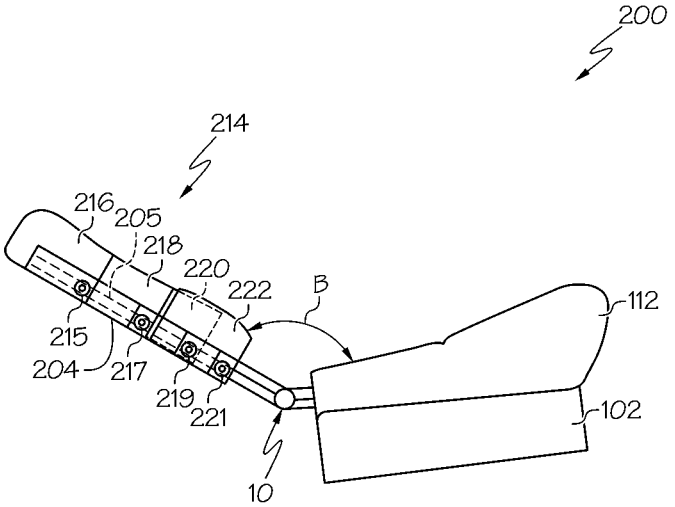
FIG. 3B schematically depicts a side cross-sectional view of the wheelchair assembly of FIG. 3A with the modular seat apparatus in a reclined position according to one or more embodiments of the present disclosure.

Referring now to FIGS. 3A-3B, an alternative embodiment of a wheelchair assembly 200 that is substantially similar to the wheelchair assembly 100 shown and described above is schematically depicted. Except as otherwise described below, it should be understood that the wheelchair assembly 200 may be configured and operable like the wheelchair assembly 100. Accordingly, like reference numerals are used to identify like components of the wheelchair assembly 200. It should be understood that one or more components of the wheelchair assembly 200 of the present example (e.g., back frame 204, back cushion 214, etc.) may be readily incorporated with the components of the wheelchair assembly 100 described above, such as, for example, the one or more wheels 106, the pair of foot rests 108, the pair of arm rests 110, and/or the like.

Referring specifically to FIG. 3A, the wheelchair assembly 200 is different than the wheelchair assembly 100 in that the wheelchair assembly 200 includes a back cushion 214 movably coupled to a back frame 204 of the wheelchair assembly 200, with the back cushion 214 including a plurality of cushion segments 216, 218, 220, 222. Each of the plurality of cushion segments 216, 218, 220, 222 includes a coupling mechanism 215, 217, 219, 221 disposed therein and movably coupled to a channel 205 of the back frame 204. The back cushion 214 of the wheelchair assembly 200 includes four cushion segments 216, 218, 220, 222 coupled to the back frame 204 via four corresponding coupling mechanisms 215, 217, 219, 221, respectively. Each of the plurality of cushion segments 216, 218, 220, 222 are configured to move along the back frame 204 in response to the coupling mechanism 215, 217, 219, 221 slidably translating within the channel 205.

It should be understood that in other embodiments the back cushion 214 of the wheelchair assembly 200 may include additional and/or fewer cushion segments and/or corresponding coupling mechanisms coupled to the channel 205 of the back frame 204 than those shown and described herein without departing from a scope of the present disclosure. The wheelchair assembly 200 is schematically depicted in the inclined position with the plurality of cushion segments 216, 218, 220, 222 positioned relatively distal from the coupling point 10 and/or the base cushion 112. With the wheelchair assembly 200 in the inclined position, the back frame 204 and the back cushion 214 are positioned at a first angle A relative to the base frame 102 and the base cushion 112.

Referring now to FIG. 3B, the wheelchair assembly 200 is schematically depicted in a reclined position with the back frame 204 and the back cushion 214 positioned at a second angle B relative to the base frame 102 and the base cushion 112, where the second angle B is greater than the first angle A of the inclined position. In this instance, with the wheelchair assembly 200 in the reclined position, the plurality of cushion segments 216, 218, 220, 222 of the back cushion 214 are moved along the back frame 204 proximally toward the coupling point 10 and/or the base cushion 112. In other words, the coupling mechanism 215, 217, 219, 221 of each of the plurality of cushion segments 216, 218, 220, 222 is positioned within the channel 205 of the back frame 204 at a second, proximal position relative to the coupling point 10 and/or the base cushion 112. The plurality of cushion segments 216, 218, 220, 222 translate along the back frame 204 in response to the back cushion 214 pivoting relative to the base cushion 112 to the reclined position.

In the embodiment, at least a first cushion segment 220 of the plurality of cushion segments 216, 218, 220, 222 is configured to translate at least partially within at least a second cushion segment 222 of the plurality of cushion segments 216, 218, 220, 222. In particular, the first cushion segment 220 is sized and shaped relatively smaller than the second cushion segment 222 such that the first cushion segment 220 is received within the second cushion segment 222 as the wheelchair assembly 200 transitions from the inclined position to the reclined position. It should be understood that the second cushion segment 222 may be formed with a hollow interior and/or include an internal channel defining a void that is sized and shaped to at least partially receive the first cushion segment 220 therein. In other embodiments, the second cushion segment 222 may be configured to receive additional cushion segments 216, 218 of the back cushion 214 therein. Additionally and/or alternatively, in some embodiments additional cushion segments 216, 218, 220 of the back cushion 214 may at least partially receive one or more of the plurality of cushion segments 216, 218, 220, 222 therein.

Still referring to FIG. 3B, the first cushion segment 220 is disposed within the second cushion segment 222 when the angle at the coupling point 10 between the back frame 204 and the base frame 102 increases. In this instance, a longitudinal length of the back cushion 214 of the wheelchair assembly 200 decreases as the first cushion segment 220 translates within the second cushion segment 222 as the wheelchair assembly 200 transitions from the inclined position to the reclined position. Accordingly, it should be understood that a longitudinal length of the back cushion 214 is selectively adjustable and decreases as the angle between the back frame 204 and the base frame 102 increases, and a longitudinal length of the back cushion 214 increases as the angle between the back frame 204 and the base frame 102 decreases.

With at least the first cushion segment 220 translated proximally toward the coupling point 10 and at least partially received within the second cushion segment 222, the remaining plurality of cushion segments 216, 218 move proximally toward the coupling point 10 in response to the coupling mechanisms 215, 217 translating along the channel 205 of the back frame 204. In other words, receipt of the first cushion segment 220 within the second cushion segment 222 provides increased spatial clearance along the back frame 204 for other cushion segments 216, 218 of the back cushion 214 to translate downward along the back frame 204. With at least the second cushion segment 222 configured to receive the first cushion segment 220 therein as the wheelchair assembly 200 transitions to the reclined position, the back cushion 214 of the wheelchair assembly 200 is operable to minimize a shear stress generated on, for example, a lower back of an occupant received on the wheelchair assembly 200.

Still referring to FIG. 3B, translating the first cushion segment 220 into the second cushion segment 222 and simultaneously translating the remaining plurality of cushion segments 216, 218 toward the coupling point 10 reduces a force applied onto a lower back of an occupant seated on the base cushion 112 as the wheelchair assembly 200 is reclined. Further translating the second cushion segment 222 toward the coupling point 10 as the first cushion segment 220 is slidably received therein may further minimize a shear stress and/or force transmitted to an occupant utilizing the wheelchair assembly 200. By minimizing a shear stress and/or force when the wheelchair assembly 200 transitions from the inclined position (FIG. 3A) to the reclined position (FIG. 3B), instances of discomfort may be minimized.

Figure 4A:
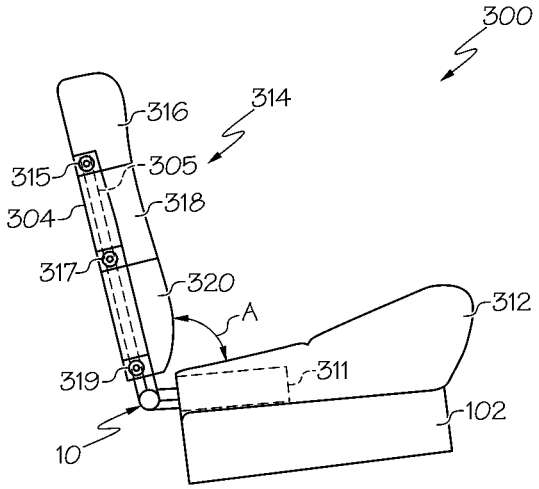
FIG. 4A schematically depicts a side cross-sectional view of another illustrative wheelchair assembly with a modular seat apparatus in an inclined position according to one or more embodiments of the present disclosure.
Figure 4B:
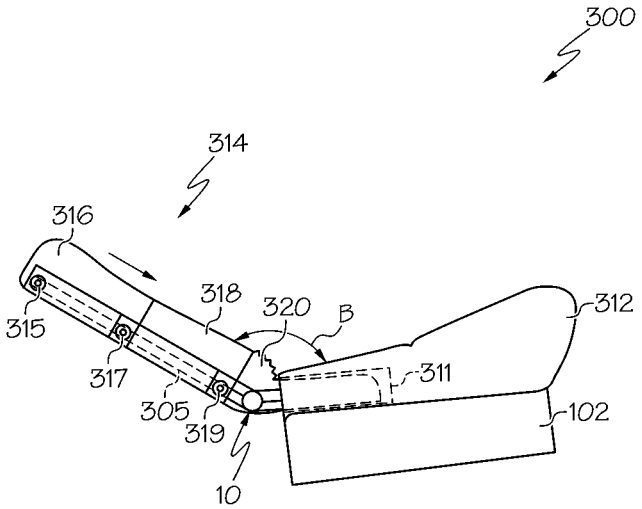
FIG. 4B schematically depicts a side cross-sectional view of the wheelchair assembly of FIG. 4A with the modular seat apparatus in a reclined position according to one or more embodiments of the present disclosure.

Referring now to FIGS. 4A-4B, an alternative embodiment of a wheelchair assembly 300 that is substantially similar to the wheelchair assembly 100 shown and described above is schematically depicted. Except as otherwise described below, it should be understood that the wheelchair assembly 300 may be configured and operable like the wheelchair assembly 100. Accordingly, like reference numerals are used to identify like components of the wheelchair assembly 300. It should be understood that one or more components of the wheelchair assembly 300 of the present example (e.g., back frame 304, cushions 312, 314, etc.) may be readily incorporated with the components of the wheelchair assembly 100 described above, such as, for example, the one or more wheels 106, the pair of foot rests 108, the pair of arm rests 110, and/or the like.

Referring specifically to FIG. 4A, the wheelchair assembly 300 is different than the wheelchair assembly 100 in that the wheelchair assembly 300 includes a base cushion 312 with an interior chamber 311 disposed therein. In particular, the interior chamber 311 of the base cushion 312 defines a void that is sized and shaped to at least partially receive one or more components of the wheelchair assembly 300 therein. The wheelchair assembly 300 further includes a back cushion 314 movably coupled to a back frame 304 of the wheelchair assembly 300, with the back cushion 314 including a plurality of cushion segments 316, 318, 320. Each of the plurality of cushion segments 316, 318, 320 includes a coupling mechanism 315, 317, 319 disposed therein and movably coupled to a channel 305 of the back frame 304.

The back cushion 314 of the wheelchair assembly 300 includes three cushion segments 316, 318, 320 coupled to the back frame 304 via three coupling mechanisms 315, 317, 319, respectively. Each of the plurality of cushion segments 316, 318, 320 are configured to move along the back frame 304 in response to the coupling mechanism 315, 317, 319 slidably translating within the channel 305. It should be understood that in other embodiments the back cushion 314 of the wheelchair assembly 300 may include additional and/or fewer cushion segments and/or corresponding coupling mechanisms coupled to the channel 305 of the back frame 304 than those shown and described herein without departing from a scope of the present disclosure. The wheelchair assembly 300 is schematically depicted in the inclined position with the plurality of cushion segments 316, 318, 320 positioned relatively distal from the coupling point 10 and/or the base cushion 312. With the wheelchair assembly 300 in the inclined position, the back frame 304 and the back cushion 314 positioned at a first angle A relative to the base frame 102 and the base cushion 312. As described in greater detail herein, the interior chamber 311 of the base cushion 312 is configured to at least partially receive one or more components of the wheelchair assembly 300 therein, such as, for example, at least one of the plurality of cushion segments 316, 318, 320.

Referring now to FIG. 4B, the wheelchair assembly 300 is schematically depicted in a reclined position with the back frame 304 and the back cushion 314 positioned at a second angle B relative to the base frame 102 and the base cushion 312 that is greater than the first angle A of the inclined position. With the wheelchair assembly 300 in the reclined position, the plurality of cushion segments 316, 318, 320 of the back cushion 314 are moved along the back frame 304 proximally toward the coupling point 10 and/or the base cushion 312. In other words, the coupling mechanism 315, 317, 319 of each of the plurality of cushion segments 316, 318, 320 is positioned within the channel 305 of the back frame 304 at a second, proximal position relative to the coupling point 10 and/or the base cushion 312. The plurality of cushion segments 316, 318, 320 translate along the back frame 304 in response to the back cushion 314 pivoting relative to the base cushion 312 to the reclined position.

In the embodiment, at least a first cushion segment 320 of the plurality of cushion segments 316, 318, 320 is configured to translate into the base cushion 312 of the wheelchair assembly 300. In particular, the first cushion segment 320 slidably translates into the interior chamber 311 of the base cushion 312 as the coupling mechanism 319 moves along the channel 305 toward the coupling point 10. In this instance, the first cushion segment 320 is positioned at least partially within the base cushion 312 when the angle at the coupling point 10 between the back frame 304 and the base frame 102 increases. A longitudinal length of the back cushion 314 of the wheelchair assembly 300 decreases as the first cushion segment 320 is received within the base cushion 312 as the wheelchair assembly 300 transitions from the inclined position to the reclined position. Accordingly, it should be understood that a longitudinal length of the back cushion 314 is selectively adjustable and decreases as the angle between the back frame 304 and the base frame 302 increases, and a longitudinal length of the back cushion 314 increases as the angle between the back frame 304 and the base frame 302 decreases.

Still referring to FIG. 4B, with at least the first cushion segment 320 of the plurality of cushion segments 316, 318, 320 translated proximally toward the coupling point 10 and disposed within the base cushion 312, the other cushion segments 316, 318 of the back cushion 314 are configured to move proximally toward the coupling point 10 as the coupling mechanisms 315, 317 translate along the channel 305 of the back frame 304. In other words, receipt of the first cushion segment 320 within the interior chamber 311 of the base cushion 312 provides increased spatial clearance along the back frame 304 for the remaining cushion segments 316, 318 of the back cushion 314 to translate downward along the back frame 304. In the present example, at least a portion of the first cushion segment 320 is received within the base cushion 312 such that at least a remaining portion of the first cushion segment 320 is exposed externally from the interior chamber 311. In some embodiments, the first cushion segment 320 of the back cushion 314 is configured to at least partially deform in response to the wheelchair assembly 300 transitioning to the reclined position such that at least the portion of the first cushion segment 320 exposed from the interior chamber 311 is compressible between the remaining cushion segments 316, 318 and the base cushion 312.

Additionally and/or alternatively, at least a portion of the first cushion segment 320 that is disposed within the interior chamber 311 of the base cushion 312 may be compressed therein as the wheelchair assembly 300 transitions to the reclined position, dependent on a size and shape of the interior chamber 311. In this instance, the first cushion segment 320 of the back cushion 314 may be formed of various suitable materials configured to be selectively deformable, such as, for example, elastomers, polymers, and/or the like. It should be understood that the first cushion segment 320 is further configured to expand when the angle between the back frame 304 and the base frame 102 decreases as the wheelchair assembly 300 transitions back to the inclined position. In some embodiments, the interior chamber 311 of the base cushion 312 may be sized and shaped to at least partially receive additional cushion segments 316, 318 of the back cushion 314 therein in response to the first cushion segment 320 translating completely within the interior chamber 311. As will be described in greater detail herein, the interior chamber 311 of the base cushion 312 may comprise various other sizes, shapes, and configurations than those shown and described herein without departing from a scope of the present disclosure.

Still referring to FIG. 4B, with at least the first cushion segment 320 configured to translate into the base cushion 312 as the wheelchair assembly 300 is transitioned to the reclined position, the back cushion 314 of the wheelchair assembly 300 is operable to minimize a shear stress and/or force generated on, for example, a lower back of an occupant received on the wheelchair assembly 300. More specifically, receiving at least a portion of the first cushion segment 320 within the base cushion 312 and simultaneously translating the remaining plurality of cushion segments 316, 318 toward the coupling point 10 reduces a force applied onto a lower back of an occupant seated on the base cushion 312 as the wheelchair assembly 300 is reclined. A compression and/or deformation of at least the portion of the first cushion segment 320 that is exposed externally from the interior chamber 311 further minimizes a shear stress and/or force transmitted to an occupant utilizing the wheelchair assembly 300. By minimizing a shear stress and/or force when the wheelchair assembly 300 transitions from the inclined position (FIG. 4A) to the reclined position (FIG. 4B), instances of discomfort may be minimized.

Figure 5A:
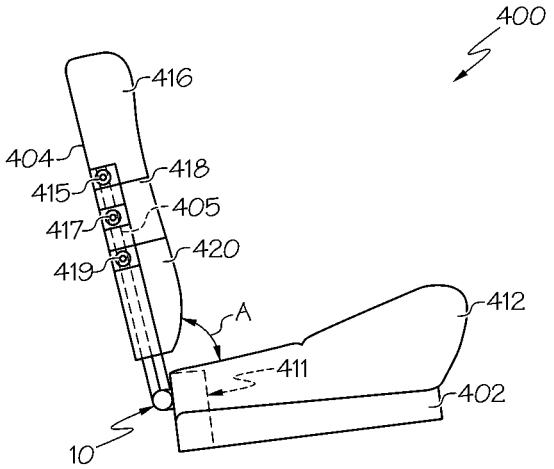
FIG. 5A schematically depicts a side cross-sectional view of another illustrative wheelchair assembly with a modular seat apparatus in an inclined position according to one or more embodiments of the present disclosure.
Figure 5B:
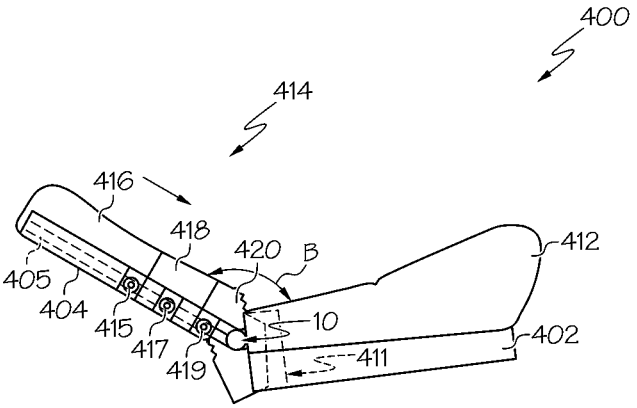
FIG. 5B schematically depicts a side cross-sectional view of the wheelchair assembly of FIG. 5A with the modular seat apparatus in a reclined position according to one or more embodiments of the present disclosure.

Referring now to FIGS. 5A-5B, an alternative embodiment of a wheelchair assembly 400 that is substantially similar to the wheelchair assembly 100 shown and described above is schematically depicted. Except as otherwise described below, it should be understood that the wheelchair assembly 400 may be configured and operable like the wheelchair assembly 100. It should be understood that one or more components of the wheelchair assembly 400 of the present example (e.g., frames 402, 404, cushions 412, 414, etc.) may be readily incorporated with the components of the wheelchair assembly 100 described above, such as, for example, the one or more wheels 106, the pair of foot rests 108, the pair of arm rests 110, and/or the like.

Referring specifically to FIG. 5A, the wheelchair assembly 400 is different than the wheelchair assembly 100 in that the wheelchair assembly 400 includes a base frame 402 with a base cushion 412 disposed thereon that collectively defines an interior chamber 411 extending therebetween. In particular, the interior chamber 411 of the base frame 402 and the base cushion 412 defines a void that is sized and shaped to at least partially receive one or more components of the wheelchair assembly 400 therein. The wheelchair assembly 400 further includes a back cushion 414 movably coupled to a back frame 404 of the wheelchair assembly 400, with the back cushion 414 including a plurality of cushion segments 416, 418, 420. Each of the plurality of cushion segments 416, 418, 420 includes a coupling mechanism 415, 417, 419 disposed therein and movably coupled to a channel 405 of the back frame 404.

The back cushion 414 of the wheelchair assembly 400 includes three cushion segments 416, 418, 420 coupled to the back frame 404 via three coupling mechanisms 415, 417, 419, respectively. Each of the plurality of cushion segments 416, 418, 420 are configured to move along the back frame 404 in response to the coupling mechanism 415, 417, 419 slidably translating within the channel 405. It should be understood that in other embodiments the back cushion 414 of the wheelchair assembly 400 may include additional and/or fewer cushion segments and/or corresponding coupling mechanisms coupled to the channel 405 of the back frame 404 than those shown and described herein without departing from a scope of the present disclosure. The wheelchair assembly 400 is schematically depicted in the inclined position with the plurality of cushion segments 416, 418, 420 positioned relatively distal from the coupling point 10 and/or the base cushion 412. With the wheelchair assembly 400 in the inclined position, the back frame 404 and the back cushion 414 are positioned at a first angle A relative to the base frame 102 and the base cushion 412. The interior chamber 411 of the base frame 402 and the base cushion 412 is configured to at least partially deflect one or more components of the wheelchair assembly 400, such as, for example, at least one of the plurality of cushion segments 416, 418, 420.

Referring now to FIG. 5B, the wheelchair assembly 400 is schematically depicted in a reclined position with the back frame 404 and the back cushion 414 positioned at a second angle B relative to the base frame 102 and the base cushion 412 that is greater than the first angle A. With the wheelchair assembly 400 in the reclined position, the plurality of cushion segments 416, 418, 420 of the back cushion 414 are moved along the back frame 404 proximally toward the coupling point 10 and/or the base cushion 412. In other words, the coupling mechanism 415, 417, 419 of each of the plurality of cushion segments 416, 418, 420 is positioned within the channel 405 of the back frame 404 at a second, proximal position relative to the coupling point 10 and/or the base cushion 412. The plurality of cushion segments 416, 418, 420 translate along the back frame 404 in response to the back cushion 414 pivoting relative to the base cushion 412 to the reclined position.

In the illustrated embodiment, at least a first cushion segment 420 of the plurality of cushion segments 416, 418, 420 is configured to translate at least partially into the base frame 402 and base cushion 412 of the wheelchair assembly 400. In particular, the first cushion segment 420 is received within and abuts against the interior chamber 411 as the coupling mechanism 419 moves along the channel 405 toward the coupling point 10. In this instance, due to a relative size and shape of the interior chamber 411, the first cushion segment 420 is deflected outwardly from the interior chamber 411 and distally away from the coupling point 10 when the angle between the back frame 404 and the base frame 102 increases. In this instance, a longitudinal length of the back cushion 414 of the wheelchair assembly 400 decreases as the first cushion segment 420 is deflected as the wheelchair assembly 400 transitions from the inclined position to the reclined position. Accordingly, it should be understood that a longitudinal length of the back cushion 414 is selectively adjustable and decreases as the angle between the back frame 404 and the base frame 402 increases, and a longitudinal length of the back cushion 414 increases as the angle between the back frame 404 and the base frame 402 decreases.

Still referring to FIG. 5B, with at least the first cushion segment 420 of the plurality of cushion segments 416, 418, 420 translated proximally toward the coupling point 10 and deflected outwardly by the interior chamber 411, the other cushion segments 416, 418 move proximally toward the coupling point 10 as the coupling mechanisms 415, 417 translate along the channel 405 of the back frame 404. In other words, a receipt and deflection of the first cushion segment 420 by the interior chamber 411 provides increased spatial clearance along the back frame 404 for other cushion segments 416, 418 of the back cushion 414 to translate downward along the back frame 404. In the present example, at least a portion of the first cushion segment 420 is received within the base frame 402 and the base cushion 312 such that at least a remaining portion of the first cushion segment 420 is exposed externally from the interior chamber 411. In some embodiments, the first cushion segment 420 of the back cushion 414 is configured to at least partially deflect in response to the wheelchair assembly 400 transitioning to the reclined position such that at least a portion of the first cushion segment 420 exposed from the interior chamber 411 is flexibly deformable.

In other words, at least the first cushion segment 420 of the plurality of cushion segments 416, 418, 420 is configured to translate relatively underneath the base cushion 412, in response to the interior chamber 411 deflecting at least a portion of the first cushion segment 420 outwardly therefrom, when the angle between the back frame 104 and the base frame 402 increases. The longitudinal length of the back cushion 414 is effectively decreased as a result of the deflection of the first cushion segment 420. Additionally and/or alternatively, at least a portion of the first cushion segment 420 that is disposed within the interior chamber 411 may be compressed therein as the wheelchair assembly 400 transitions to the reclined position, dependent on a size and shape of the interior chamber 411. It should be understood that the first cushion segment 420 is further configured to expand when the angle between the back frame 404 and the base frame 402 decreases as the wheelchair assembly 400 transitions back to the inclined position. In some embodiments, the interior chamber 411 may be sized and shaped to at least partially receive and/or deflect additional cushion segments 416, 418 of the back cushion 414 therein.

Still referring to FIG. 5B, with at least the first cushion segment 420 configured to translate into and deflect outwardly from the interior chamber 411 as the wheelchair assembly 400 is transitioned to the reclined position, the back cushion 414 of the wheelchair assembly 400 is operable to minimize a shear stress generated on, for example, a lower back of an occupant received on the wheelchair assembly 400. More specifically, deflecting the first cushion segment 420 below the base cushion 412 via the interior chamber 411 and simultaneously translating the remaining plurality of cushion segments 416, 418 toward the coupling point 10 reduces a force applied onto a lower back of an occupant seated on the base cushion 412 as the wheelchair assembly 400 is reclined. A compression and/or deformation of at least a portion of the first cushion segment 420 received within and/or exposed externally of the interior chamber 411 further minimizes a shear stress and/or force transmitted to an occupant utilizing the wheelchair assembly 400. By minimizing a shear stress and/or force when the wheelchair assembly 400 transitions from the inclined position (FIG. 5A) to the reclined position (FIG. 5B), instances of discomfort may be minimized.

Figure 6A:
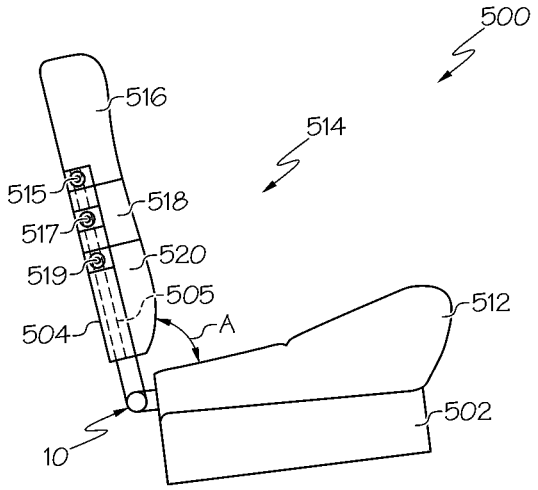
FIG. 6A schematically depicts a side cross-sectional view of another illustrative wheelchair assembly with a modular seat apparatus in an inclined position according to one or more embodiments of the present disclosure.
Figure 6B:
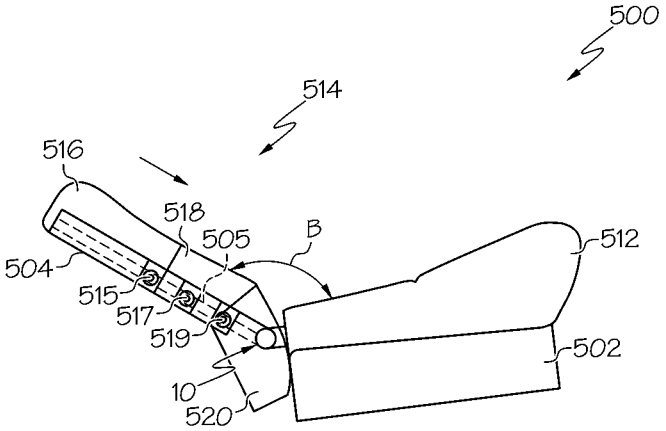
FIG. 6B schematically depicts a side cross-sectional view of the wheelchair assembly of FIG. 6A with the modular seat apparatus in a reclined position according to one or more embodiments of the present disclosure.

Referring now to FIGS. 6A-6B, an alternative embodiment of a wheelchair assembly 500 that is substantially similar to the wheelchair assembly 100 shown and described above is schematically depicted. Except as otherwise described below, it should be understood that the wheelchair assembly 500 may be configured and operable like the wheelchair assembly 100. It should be understood that one or more components of the wheelchair assembly 500 of the present example (e.g., frame 502, 504, cushions 512, 514, etc.) may be readily incorporated with the components of the wheelchair assembly 100 described above, such as, for example, the one or more wheels 106, the pair of foot rests 108, the pair of arm rests 110, and/or the like.

Referring specifically to FIG. 6A, the wheelchair assembly 500 includes a base frame 502 with a base cushion 512 disposed thereon and a back frame 504 with a back cushion 514 disposed thereon. In particular, the back cushion 514 is movably coupled to a back frame 504 of the wheelchair assembly 500, with the back cushion 514 including a plurality of cushion segments 516, 518, 520. Each of the plurality of cushion segments 516, 518, 520 includes a coupling mechanism 515, 517, 519 disposed therein and movably coupled to a channel 505 of the back frame 504. In the present example, the back cushion 514 of the wheelchair assembly 500 includes three cushion segments 516, 518, 520 coupled to the channel 505 of the back frame 504 via three respective coupling mechanisms 515, 517, 519. Each of the plurality of cushion segments 516, 518, 520 are configured to move along the back frame 504 in response to the coupling mechanism 515, 517, 519 slidably translating within the channel 505.

Still referring to FIG. 6A, it should be understood that in other embodiments the back cushion 514 of the wheelchair assembly 500 may include additional and/or fewer cushion segments and/or corresponding coupling mechanisms coupled to the channel 505 of the back frame 504 than those shown and described herein without departing from a scope of the present disclosure. The wheelchair assembly 500 is schematically depicted in the inclined position with the plurality of cushion segments 516, 518, 520 positioned distally away from the coupling point 10 and/or the base cushion 512. With the wheelchair assembly 500 in the inclined position, the back frame 504 and the back cushion 514 are positioned at a first angle A relative to the base frame 502 and the base cushion 512. As shown in FIG. 6A, the plurality of cushion segments 516, 518, and 520 are parallel to the back frame 504 when the wheelchair assembly 500 is in the inclined position.

Referring now to FIG. 6B, the wheelchair assembly 500 is schematically depicted in a reclined position with the back frame 504 and the back cushion 514 positioned at a second angle B relative to the base frame 502 and the base cushion 512 that is greater than the first angle A.

In this instance, with the wheelchair assembly 500 in the reclined position, the plurality of cushion segments 516, 518, 520 of the back cushion 514 are moved along the back frame 504 toward the coupling point 10 and/or the base cushion 512. In other words, the coupling mechanism 515, 517, 519 of each of the plurality of cushion segments 516, 518, 520 is positioned within the channel 505 of the back frame 504 at a second, proximate position relative to the coupling point 10 and/or the base cushion 512. The plurality of cushion segments 516, 518, 520 translate along the back frame 504 in response to the back cushion 514 pivoting relative to the base cushion 512 to the reclined position.

An alignment of at least a first cushion segment 520 of the plurality of cushion segments 516, 518, 520 is at least partially transverse relative to the remaining plurality of cushion segments 516, 518 when the wheelchair assembly 500 is in the reclined position. In other words, the first cushion segment 520 is pivoted about the coupling mechanism 519 such that the first cushion segment 520 includes a transverse configuration relative to a configuration of the remaining plurality of cushion segments 516, 518 along the back frame 504. In the present example, at least a portion of the first cushion segment 520 is pivoted distally away from the base cushion 512 such that the first cushion segment 520 extends outwardly from the back frame 504 and relatively below the base cushion 512. The remaining cushion segments 516, 518 of the back cushion 514 extend parallel to a longitudinal length of the back frame 504 when the wheelchair assembly 500 is in the reclined position. In the illustrated example, the first cushion segment 520 is positioned proximate to the coupling point 10 and the base cushion 512 relative to the remaining cushion segments 516, 518 of the back cushion 514.

Still referring to FIG. 6B, the first cushion segment 520 is in transverse alignment with a longitudinal length of the back frame 504 when the angle at the coupling point 10 between the back frame 504 and the base frame 502 increases. Further, the back cushion 514 translates toward the coupling point 10. In this instance, a longitudinal length of the back cushion 514 of the wheelchair assembly 500 decreases as the first cushion segment 520 translates downwardly along the channel 505 away from the coupling point 10 as the wheelchair assembly 500 transitions from the inclined position to the reclined position. Accordingly, it should be understood that a longitudinal length of the back cushion 514 is selectively adjustable and decreases as the angle between the back frame 504 and the base frame 502 increases, and a longitudinal length of the back cushion 514 increases as the angle between the back frame 504 and the base frame 502 increases.

With the plurality of cushion segments 516, 518, 520 moving toward the coupling point 10 in response to the coupling mechanisms 515, 517, 519 translating along the channel 505 of the back frame 504, at least the first cushion segment 520 pivots downwardly below the base cushion 512. With first cushion segment 520 configured to pivot away the base cushion 512 as the wheelchair assembly 500 transitions to the reclined position, the back cushion 514 of the wheelchair assembly 500 is operable to minimize a shear stress generated on, for example, a lower back of an occupant received on the wheelchair assembly 500. By minimizing a shear stress and/or force when the wheelchair assembly 500 transitions from the inclined position (FIG. 6A) to the reclined position (FIG. 6B), instances of discomfort may be minimized.

Figure 7A:
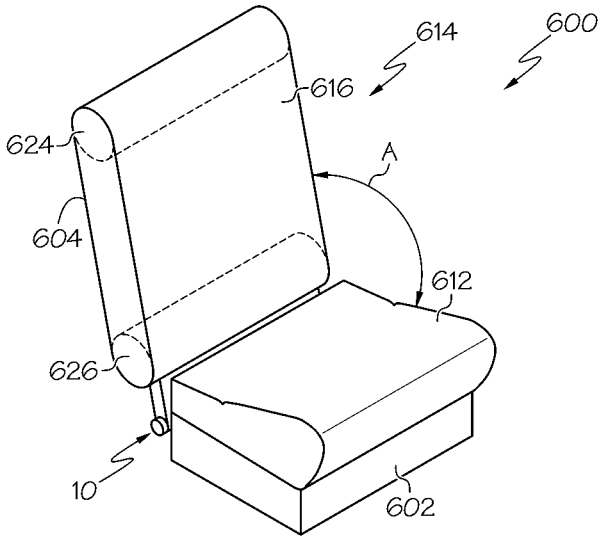
FIG. 7A schematically depicts a side cross-sectional view of another illustrative wheelchair assembly with a modular seat apparatus in an inclined position according to one or more embodiments of the present disclosure.
Figure 7B:
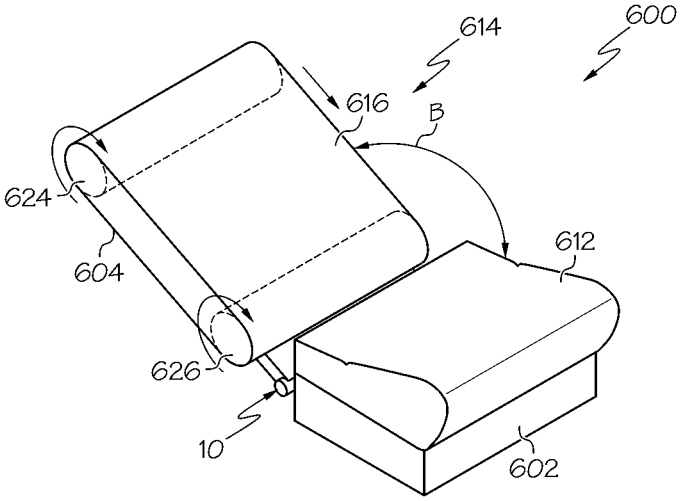
FIG. 7B schematically depicts a side cross-sectional view of the wheelchair assembly of FIG. 7A with the modular seat apparatus in a reclined position according to one or more embodiments of the present disclosure.

Referring now to FIGS. 7A-7B, an alternative embodiment of a wheelchair assembly 600 is schematically depicted. Except as otherwise described below, it should be understood that the wheelchair assembly 600 may be configured and operable like the wheelchair assembly 100. It should be understood that one or more components of the wheelchair assembly 600 of the present example (e.g., frame 602, 604, cover 616, etc.) may be readily incorporated with the components of the wheelchair assembly 100 described above, such as, for example, the one or more wheels 106, the pair of foot rests 108, the pair of arm rests 110, and/or the like.

As described in detail below, in this example, a translatable cover 614 is translated up and down a back frame 604 by use of one or more rollers 624, 625 to reduce shear stress on a user.

Referring specifically to FIG. 7A, the wheelchair assembly 600 includes a base frame 602 with a base cushion 612 disposed thereon and a back frame 604 with a translatable cover 614 disposed thereon. The wheelchair assembly 600 is schematically depicted in an inclined position with the back frame 604 and the back cushion 614 oriented at a first angle A relative to the base frame 602 the base cushion 612. The back frame 604 further comprises at least one roller, which in the present example includes a first roller 624 position distally from the coupling point 10 along a longitudinal length of the back frame 604 and extending a lateral width of the back frame and a second roller 626 positioned proximate to the coupling point 10 along a longitudinal length of the back frame 604 and extending a lateral width of the back frame 604. It should be understood that any number of rollers may be utilized.

In the present example, a translatable cover 614 is disposed about the back frame 604 such that the translatable cover 614 covers the back frame 604. The translatable cover 614 may be made of a plurality of materials such that the translatable cover 614 provides cushion to the user of the wheelchair assembly 600.

The translatable cover 614 is wrapped around the first and second rollers 624, 262. The first and second rollers 624, 626 are configured to a rotated to translate the translatable cover 614 up and down the back frame 604. For example, one or more actuators may control the rotational movement of the first and second rollers 624, 626. As a non-limiting example, the one or more actuators may be one or more servo motors.

FIG. 7A illustrates the wheelchair assembly 600 in an inclined position with the back frame 604 and the translatable cover 614 positioned at a first angle A relative to the base frame 602. FIG. 8B illustrates the wheelchair assembly in a reclined position with the back frame 604 and the translatable cover 614 positioned at a second angle B relative to the base frame 602, wherein the second angle B is greater than the first angle A.

When the wheelchair assembly 600 transitions to the reclined position, the first and second rollers 624, 626 are controlled to rotate in a clockwise direction as shown in FIG. 7B. The rotation of the first and second rollers 624, 626 causes a user-facing surface 616 of the translatable cover 614 to be pulled downward toward the coupling point 10. In other words, the translatable cover 614 moves in a manner similar to that of a treadmill. The movement of the translatable cover 614 in a downward direction has a similar effect to reduce shear on the back of a user as does reducing the longitudinal length of the back cushion as described in the other embodiments. When the wheelchair assembly 600 transitions from the reclined position to the inclined position, the first and second rollers 624, 626 rotate in the opposite direction to cause the user-facing surface of the translatable cover 614 to lift in an upward direction away from the coupling point 10.

Figure 8A:
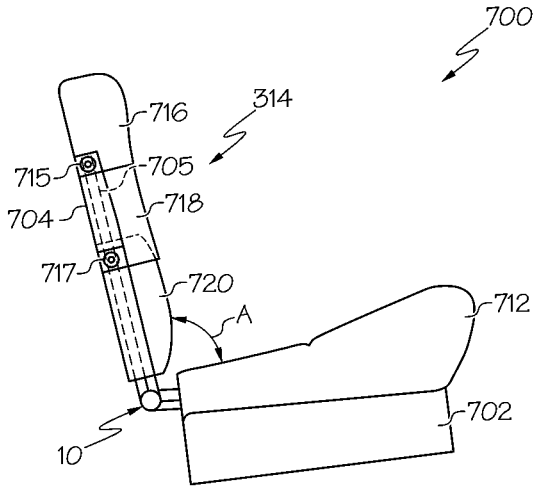
FIG. 8A schematically depicts a side cross-sectional view of another illustrative wheelchair assembly with a modular seat apparatus in an inclined position according to one or more embodiments of the present disclosure.
Figure 8B:
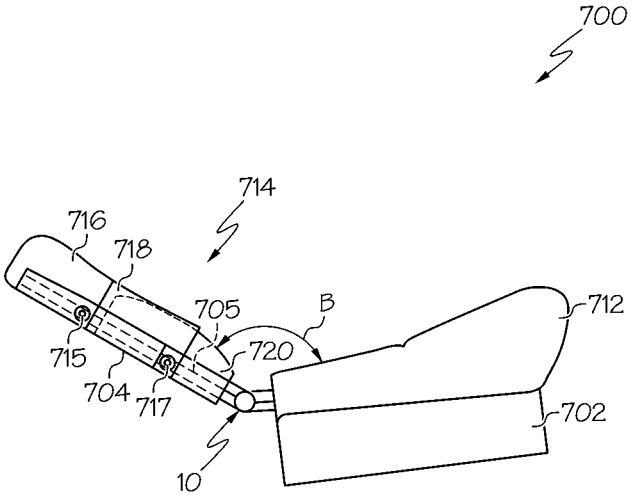
FIG. 8B schematically depicts a side cross-sectional view of the wheelchair assembly of FIG. 8A with the modular seat apparatus in a reclined position according to one or more embodiments of the present disclosure.

Referring now to FIGS. 8A-8B, an alternative embodiment of a wheelchair assembly 700 that is substantially similar to the wheelchair assembly 100 shown and described above is schematically depicted. Except as otherwise described below, it should be understood that the wheelchair assembly 700 may be configured and operable like the wheelchair assembly 100. Accordingly, like reference numerals are used to identify like components of the wheelchair assembly 700. It should be understood that one or more components of the wheelchair assembly 700 of the present example (e.g., back frame 704, back cushion 714, etc.) may be readily incorporated with the components of the wheelchair assembly 100 described above, such as, for example, the one or more wheels 106, the pair of foot rests 108, the pair of arm rests 110, and/or the like.

Referring specifically to FIG. 8A, the wheelchair assembly 700 is different than the wheelchair assembly 100 in that the wheelchair assembly 700 includes a back cushion 714 movably coupled to a back frame 704 of the wheelchair assembly 700, with the back cushion 714 including a plurality of cushion segments 716, 718, 720. At least a first cushion segment 720 of the back cushion 714 is fixed to the back frame 704 such that the first cushion segment 720 is immovable. The remaining plurality of cushion segments 716, 718 of the back cushion 714 include a coupling mechanism 715, 717 disposed therein and movably coupled to a channel 705 of the back frame 704. The back cushion 714 of the wheelchair assembly 700 includes three cushion segments 716, 718, 720 coupled to the back frame 704, with a second cushion segment 718 and a third cushion segment 716 coupled thereto via corresponding coupling mechanisms 715, 717, respectively. Accordingly, the second cushion segment 718 and the third cushion segment 716 are configured to move along the back frame 704 in response to the coupling mechanism 715, 717 slidably translating within the channel 705.

The wheelchair assembly 700 is schematically depicted in the inclined position with the cushion segments 716, 718 positioned relatively distal from the coupling point 10 and the back cushion 714 positioned at a first angle A relative to the base frame 102. At least a portion of the first cushion segment 720 is disposed within the second cushion segment 718 when the wheelchair assembly 700 is in the inclined position. In particular, the first cushion segment 720 is sized and shaped relatively smaller than the second cushion segment 718 such that the first cushion segment 720 is received within the second cushion segment 718. It should be understood that the second cushion segment 718 may be formed with a hollow interior and/or include an internal channel defining a void that is sized and shaped to at least partially receive the first cushion segment 720 therein. It should further be understood that in other embodiments the back cushion 714 of the wheelchair assembly 700 may include additional and/or fewer cushion segments and/or corresponding coupling mechanisms than those shown and described herein without departing from a scope of the present disclosure.

Referring now to FIG. 8B, the wheelchair assembly 700 is schematically depicted in a reclined position with the back frame 704 and the back cushion 714 positioned at a second angle B relative to the base frame 702 and the base cushion 712, where the second angle B is greater than the first angle A. With the wheelchair assembly 700 in the reclined position, the plurality of cushion segments 716, 718 of the back cushion 714 are moved along the back frame 704 proximally toward the coupling point 10 and/or the base cushion 712. In other words, the coupling mechanism 715, 717 of each of the plurality of cushion segments 716, 718 is positioned within the channel 705 of the back frame 704 at a second, proximal position relative to the coupling point 10 and/or the base cushion 712. The plurality of cushion segments 716, 718 translate along the back frame 704 in response to the back cushion 714 pivoting relative to the base cushion 712 to the reclined position.

With the first cushion segment 720 of the back cushion 714 securely fixed along the back frame 704, the second cushion segment 718 is configured to translate over the first cushion segment 720 as the wheelchair assembly 700 transitions from the inclined position to the reclined position. In particular, the first cushion segment 720 is at least partially received within the second cushion segment 718 of the back cushion 714 as the second cushion segment 718 moves toward the first cushion segment 720. In other embodiments, additional cushion segments 716 of the back cushion 714 may be configured to translate over at least the first cushion segment 720 of the back cushion 714. Additionally and/or alternatively, in some embodiments additional cushion segments 716 of the back cushion 714 may at least partially translate over other cushion segments of the back cushion 714, such as, for example, the second cushion segment 718.

Still referring to FIG. 8B, the first cushion segment 720 is disposed within the second cushion segment 718 when the angle at the coupling point 10 between the back frame 704 and the base frame 702 increases. In this instance, a longitudinal length of the back cushion 714 of the wheelchair assembly 700 decreases as the second cushion segment 718 translates over the first cushion segment 720 as the wheelchair assembly 700 transitions from the inclined position to the reclined position. Accordingly, it should be understood that a longitudinal length of the back cushion 714 is selectively adjustable and decreases as the angle between the back frame 704 and the base frame 702 increases, and a longitudinal length of the back cushion 714 increases as the angle between the back frame 704 and the base frame 702 decreases.

With at least the second cushion segment 718 translated proximally toward the coupling point 10 and at least partially over the first cushion segment 720, the remaining plurality of cushion segments 716 move proximally toward the coupling point 10 in response to the coupling mechanisms 715 translating along the channel 705 of the back frame 704. In other words, receipt of the first cushion segment 720 within the second cushion segment 718 provides increased spatial clearance along the back frame 704 for other cushion segments 716 of the back cushion 714 to translate downward along the back frame 704. It should be understood that in some embodiments each of the plurality of cushion segments 716, 718, 720 may include a hollow void defined therein such that each of the plurality of cushion segments 716, 718, 720 is configured to translate within the hollow void of a relatively higher cushion segment 716, 718, 720 of the back cushion 714 when the angle between the base frame 702 and the back frame 704 increases. In this instance, each of the plurality of cushion segments 716, 718, 720 is configured to translate out of a hollow void of a relatively higher cushion segment 716, 718, 720 of the back cushion 714 when the angle between the base frame 702 and the back frame 704 decreases.

Still referring to FIG. 8B, with at least the second cushion segment 718 configured to receive the first cushion segment 720 therein as the wheelchair assembly 700 transitions to the reclined position, the back cushion 714 of the wheelchair assembly 700 is operable to minimize a shear stress generated on, for example, a lower back of an occupant received on the wheelchair assembly 700. Translating the second cushion segment 718 over the first cushion segment 720 and simultaneously translating the remaining plurality of cushion segments 716 toward the coupling point 10 reduces a force applied onto a lower back of an occupant seated on the base cushion 712 as the wheelchair assembly 700 is reclined. Further translating the second cushion segment 718 toward the coupling point 10 as the first cushion segment 720 is slidably received therein may further minimize a shear stress and/or force transmitted to an occupant utilizing the wheelchair assembly 700. By minimizing a shear stress and/or force when the wheelchair assembly 700 transitions from the inclined position (FIG. 8A) to the reclined position (FIG. 8B), instances of discomfort may be minimized.

Although embodiments described herein have been described as decreasing the longitudinal length of the back cushion (or translating a translatable cover downward) when transitioning the wheelchair assembly from an inclined position to a reclined position, any of the wheelchair assemblies may further include an operational mode wherein the longitudinal length of the back cushion increases (or the translatable cover is translated upward) when transitioning the wheelchair assembly from an inclined position to a reclined position. This opposite motion may be beneficial to assist in lifting the user or otherwise positioning the user in performing certain tasks. For example, this opposite motion may put the user in a better position to put on or take off pants.

Figure 9A:
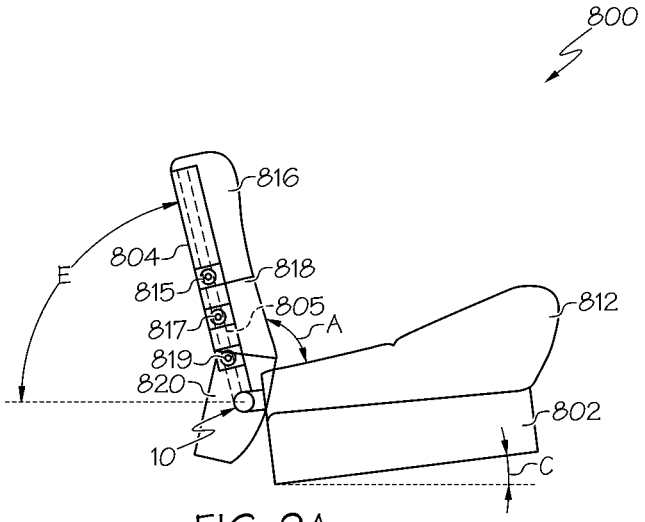
FIG. 9A schematically depicts a side cross-sectional view of another illustrative wheelchair assembly with a modular seat apparatus in an inclined position according to one or more embodiments of the present disclosure.
Figure 9B:
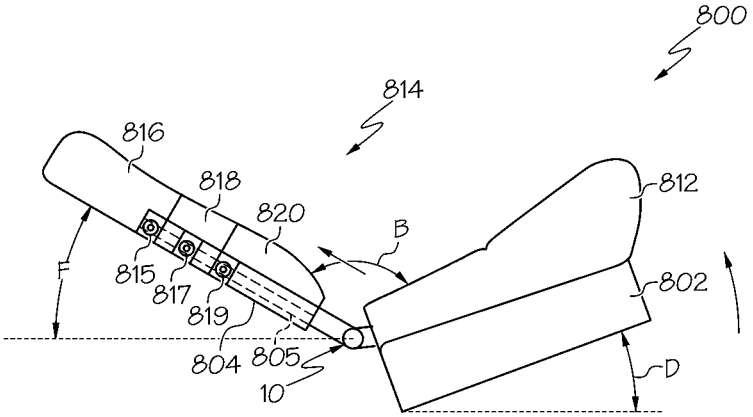
FIG. 9B schematically depicts a side cross-sectional view of the wheelchair assembly of FIG. 9A with the modular seat apparatus in a reclined position according to one or more embodiments of the present disclosure.

Referring now to FIGS. 9A-9B, an alternative embodiment of a wheelchair assembly 800 that is substantially similar to the wheelchair assembly 100 and 500 shown and described above but including a lifting operation is schematically depicted. Except as otherwise described below, it should be understood that the wheelchair assembly 800 may be configured like the wheelchair assembly 100. It should be understood that one or more components of the wheelchair assembly 800 of the present example (e.g., frame 802, 804, cushions 812, 814, etc.) may be readily incorporated with the components of the wheelchair assembly 100 described above, such as, for example, the one or more wheels 106, the pair of foot rests 108, the pair of arm rests 110, and/or the like.

Referring specifically to FIG. 9A, the wheelchair assembly 800 includes a base frame 802 with a base cushion 812 disposed thereon and a back frame 804 with a back cushion 814 disposed thereon. In particular, the back cushion 814 is movably coupled to a back frame 804 of the wheelchair assembly 800, with the back cushion 814 including a plurality of cushion segments 816, 818, 820. Each of the plurality of cushion segments 816, 818, 820 includes a coupling mechanism 815, 817, 819 disposed therein and movably coupled to a channel 805 of the back frame 804. In the present example, the back cushion 814 of the wheelchair assembly 800 includes three cushion segments 816, 818, 820 coupled to the channel 805 of the back frame 804 via three respective coupling mechanisms 815, 817, 819. Each of the plurality of cushion segments 816, 818, 820 are configured to move along the back frame 804 in response to the coupling mechanism 815, 817, 819 slidably translating within the channel 805.

In this mode of operation, an alignment of at least a first cushion segment 820 of the plurality of cushion segments 816, 818, 820 is at least partially transverse relative to the remaining plurality of cushion segments 816, 818 when the wheelchair assembly 800 is in the inclined position. In other words, the first cushion segment 820 is pivoted about the coupling mechanism 819 such that the first cushion segment 820 includes a transverse configuration relative to a configuration of the remaining plurality of cushion segments 816, 818 along the back frame 804. In the present example, at least a portion of the first cushion segment 820 is pivoted distally away from the base cushion 812 such that the first cushion segment 820 extends outwardly from the back frame 804 and relatively below the base cushion 812. The remaining cushion segments 816, 818 of the back cushion 814 extend parallel to a longitudinal length of the back frame 804 when the wheelchair assembly 800 is in the inclined position. In the embodiment, the first cushion segment 820 is positioned proximate to the coupling point 10 and the base cushion 812 relative to the remaining cushion segments 816, 818 of the back cushion 814.

Still referring to FIG. 9A, it should be understood that in other embodiments the back cushion 814 of the wheelchair assembly 800 may include additional and/or fewer cushion segments and/or corresponding coupling mechanisms coupled to the channel 805 of the back frame 804 than those shown and described herein without departing from a scope of the present disclosure. The wheelchair assembly 800 is schematically depicted in the inclined position with the plurality of cushion segments 816, 818, 820 positioned relatively proximate to the coupling point 10 and/or the base cushion 812. With the wheelchair assembly 800 in the inclined position, the back frame 804 and the back cushion 814 are positioned at a first angle A relative to the base frame 802 and the base cushion 812. The seat frame 802 may be positioned at a third angle C relative to a plane parallel to the surface on which the wheelchair assembly 800 is positioned (i.e., the ground). Additionally, the back frame 804 and the back cushion 814 are positioned at a fifth angle E relative to the plane parallel to the surface on which the wheelchair assembly 800 is positioned.

Referring now to FIG. 9B, the wheelchair assembly 800 is schematically depicted in a reclined position with the back frame 804 and the back cushion 814 positioned at a second angle B relative to the base frame 802 and the base cushion. Additionally, the back frame 804 and the back cushion 814 are positioned at a sixth angle F relative to the plane parallel to the surface on which the wheelchair assembly 800 is positioned. The sixth angle F is less than the fifth angle E. Additionally, the seat frame 802 and the seat cushion 812 are configured to pivot upwardly and toward the back frame 804 and the back cushion 814 such that the seat frame 802 is positioned at a fourth angle D that is greater than the third angle C.

In this instance, with the wheelchair assembly 800 in the reclined position, the plurality of cushion segments 816, 818, 820 of the back cushion 814 are moved along the back frame 804 distally away from the coupling point 10 and/or the base cushion 812. In other words, the coupling mechanism 815, 817, 819 of each of the plurality of cushion segments 816, 818, 820 is positioned within the channel 805 of the back frame 804 at a second, distal position relative to the coupling point 10 and/or the base cushion 812. The plurality of cushion segments 816, 818, 820 translate along the back frame 804 in response to the back cushion 814 pivoting relative to the base cushion 812 to the reclined position.

In the embodiment, at least the first cushion segment 820 of the back cushion 814 is configured to pivot inwardly about the coupling mechanism 819 and toward the back frame 804, such that the first cushion segment 820 is oriented parallel to a longitudinal length of the back frame 804 and the remaining cushion segments 816, 818 of the back cushion 814. In particular, at least the portion of the first cushion segment 820 positioned relatively below the base cushion 812 in the inclined position is pivoted above the base cushion 812 when the wheelchair assembly 800 is transitioned to the reclined position. Additionally, the plurality of cushion segments 816, 818, 820 of the back cushion 814 are translated along the back frame 804 in response to the plurality of coupling mechanisms 815, 817, 819 slidably moving within the channel 805 away from the coupling point 10.

Still referring to FIG. 9B, the first cushion segment 820 is in parallel alignment with a longitudinal length of the back frame 804 when the angle at the coupling point 10 between the back frame 804 and the base frame 802 increases. In this instance, a longitudinal length of the back cushion 814 of the wheelchair assembly 800 increases as the first cushion segment 820 translates upwardly along the channel 805 away from the coupling point 10 as the wheelchair assembly 800 transitions from the inclined position to the reclined position. Accordingly, it should be understood that a longitudinal length of the back cushion 814 is selectively adjustable and increases as the angle between the back frame 804 and the base frame 802 increases, and a longitudinal length of the back cushion 814 decreases as the angle between the back frame 804 and the base frame 802 increases.

With the plurality of cushion segments 816, 818, 820 moving distally away from the coupling point 10 in response to the coupling mechanisms 815, 817, 819 translating along the channel 805 of the back frame 804, at least the first cushion segment 820 pivots upwardly above the base cushion 812 and toward the back frame 804, in alignment with a configuration of the remaining cushion segments 816, 818. In other words, translation of the cushion segments 816, 818, 820 along a longitudinal length of the back frame 804 provides increased spatial clearance along the back frame 804 for the first cushion segment 820 of the back cushion 814 to pivot upwardly in alignment with the cushion segments 816, 818, 820.

Still referring to FIG. 9B, pivoting the first cushion segment 820 into alignment with the remaining cushion segments 816, 818 of the back cushion 814 and simultaneously translating the plurality of cushion segments 816, 818, 820 distally from the coupling point 10 increases a longitudinal length of the back cushion 814. The lengthening of the back cushion 814 and the pivoting of the seat cushion 812 upward causes the torso of the user to be upwardly lifted, which may be beneficial in assisting the user in various tasks, such as changing pants and the like.

The above-described system includes a wheelchair assembly including a modular seat apparatus that has a base frame with a base cushion disposed thereon and a back frame with a back cushion disposed thereon. The back cushion including a plurality of cushion segments defining a longitudinal length of the back cushion. The back frame being pivotably coupled to the base frame such that the back cushion is positioned at an angle relative to the base cushion. The plurality of cushion segments is configured to translate in response to the back cushion pivoting relative to the base cushion such that the longitudinal length of the back cushion decreases as the angle increases, and the longitudinal length of the back cushion increases as the angle decreases.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A modular seat apparatus comprising:

a base cushion; and a back cushion including a plurality of segments defining a longitudinal length of the back cushion, wherein the back cushion is pivotably coupled to the base cushion such that the back cushion is oriented at an angle relative to the base cushion, and the plurality of segments comprises at least three segments;

wherein the plurality of segments is configured to translate in response to the back cushion pivoting relative to the base cushion such that the longitudinal length of the back cushion decreases as the angle increases and the longitudinal length of the back cushion increases as the angle decreases.

2. The modular seat apparatus of claim 1, wherein at least a first segment of the plurality of segments is configured to translate inside at least a second segment of the plurality of segments when the angle increases, thereby decreasing the longitudinal length of the back cushion.

3. The modular seat apparatus of claim 1, wherein at least a first segment of the plurality of segments is configured to pivot behind at least a second segment of the plurality of segments when the angle increases, thereby decreasing the longitudinal length of the back cushion.

4. The modular seat apparatus of claim 1, wherein at least a first segment of the plurality of segments is configured to translate inside the base cushion when the angle increases, thereby decreasing the longitudinal length of the back cushion.

5. The modular seat apparatus of claim 4, wherein the base cushion includes an interior chamber defining a void that is sized and shaped to at least partially receive the first segment therein when the angle increases to a reclined position.

6. The modular seat apparatus of claim 1, wherein at least a first segment of the plurality of segments is configured to translate underneath the base cushion when the angle increases, thereby decreasing the longitudinal length of the back cushion.

7. The modular seat apparatus of claim 1, wherein at least a first segment of the plurality of segments is configured to translate away from the base cushion when the angle increases, thereby decreasing the longitudinal length of the back cushion.

8. The modular seat apparatus of claim 1, wherein each of the plurality of segments include a hollow void defined therein such that each of the plurality of segments is configured to translate within the hollow void of a relatively higher segment of the plurality of segments when the angle increases, thereby decreasing the longitudinal length of the back cushion.

9. The modular seat apparatus of claim 8, wherein each of the plurality of segments is configured to translate out of the hollow void of the relatively higher segment of the plurality of segments when the angle decreases, thereby increasing the longitudinal length of the back cushion.

10. The modular seat apparatus of claim 1, wherein at least a first segment of the plurality of segments is configured to compress when the angle increases thereby decreasing the longitudinal length of the back cushion, and further configured to expand when the angle decreases thereby increasing the longitudinal length of the back cushion.

11. The modular seat apparatus of claim 1, wherein the base cushion and the back cushion are configured to transition from a seated position to a lifting position by:

increasing an angle between the base cushion and a plane parallel to a ground surface;

decreasing an angle between the back cushion and the plane parallel to the ground surface; and increasing the longitudinal length of the back cushion.

12. A wheelchair assembly comprising:

a base frame including a plurality of wheels coupled thereto; and a back frame including a plurality of cushion segments that define a length of the back frame, the back frame is pivotable relative to the base frame about a gap formed therebetween;

wherein the plurality of cushion segments comprises at least three cushion segments, and the plurality of cushion segments is configured to translate relative to the gap in response to the back frame pivoting relative to the base frame such that the length of the back frame is selectively adjustable as an angle between the back frame and the base frame is increased or decreased; and wherein the length of the back frame decreases as the angle between the back frame and the base frame increases, and the length of the back frame increases as the angle between the back frame and the base frame decreases.

13. The wheelchair assembly of claim 12, wherein at least a first cushion segment of the plurality of cushion segments is configured to translate inside at least a second cushion segment of the plurality of cushion segments when the angle increases, thereby decreasing the length of the back frame.

14. The wheelchair assembly of claim 12, wherein at least a first cushion segment of the plurality of cushion segments is configured to pivot behind at least a second cushion segment of the plurality of cushion segments when the angle increases, thereby decreasing the length of the back frame.

15. The wheelchair assembly of claim 12, wherein at least a first cushion segment of the plurality of cushion segments is configured to translate inside the base frame when the angle decreases, thereby decreasing the longitudinal length of the back frame.

16. The wheelchair assembly of claim 12, wherein at least a first segment of the plurality of segments is configured to translate away from the base frame when the angle increases, thereby decreasing the longitudinal length of the back frame.

17. The wheelchair assembly of claim 15, wherein the base frame and the back frame are configured to transition from a seated position to a lifting position by:

increasing an angle between the base frame and a plane parallel to a support surface of the wheelchair assembly;

decreasing an angle between the back frame and the plane parallel to the support surface of the wheelchair assembly; and increasing the longitudinal length of the back frame.

18. A wheelchair assembly comprising:

a base frame comprising a base cushion positioned thereon;

a back frame comprising at least one roller; and a translatable cover disposed about the back frame and the at least one roller, wherein the at least one roller is operable to translate a user-facing surface of the translatable cover toward and away from the base frame based on an angle between the back frame and the base frame.

19. The wheelchair assembly of claim 18, wherein the user-facing surface of the translatable cover translates toward the base frame as the angle between the back frame and the base frame increases.

20. The wheelchair assembly of claim 18, wherein the at least one roller comprises a first roller and a second roller.

* * * * *